US006886640B1

(12) United States Patent
Dushkin et al.

(10) Patent No.: US 6,886,640 B1
(45) Date of Patent: May 3, 2005

(54) FLUID SPRAY NOZZLE AND FIRE EXTINGUISHER

(75) Inventors: Andrei Leonidovich Dushkin, Moscow (RU); Alexandr Vladimirovich Karpyshev, Moscow (RU)

(73) Assignee: Obschestvo s Organichennoi Otvetstvennostju "Unipat", Moscow (RU)

( * ) Notice: Subject to any disclaimer, the term of this patent is extended or adjusted under 35 U.S.C. 154(b) by 0 days.

(21) Appl. No.: 10/181,148

(22) PCT Filed: Apr. 17, 2000

(86) PCT No.: PCT/RU00/00134

§ 371 (c)(1),
(2), (4) Date: Jul. 15, 2002

(87) PCT Pub. No.: WO01/51131

PCT Pub. Date: Jul. 19, 2001

(30) Foreign Application Priority Data

Jan. 13, 2000 (RU) ..... 2000100616

(51) Int. Cl.[7] ..... A62C 11/00

(52) U.S. Cl. ..... 169/30; 169/74; 169/71; 239/323; 239/599

(58) Field of Search ..... 169/74, 30, 71; 239/599, 597, 373, 323, 320

(56) References Cited

U.S. PATENT DOCUMENTS

| | | | | | |
|---|---|---|---|---|---|
| 2,695,814 | A | * | 11/1954 | Both | 239/309 |
| 2,953,304 | A | * | 9/1960 | Sellinger | 239/322 |
| 3,189,231 | A | * | 6/1965 | Kibbel, Jr. et al. | 222/389 |
| 3,655,554 | A | * | 4/1972 | Fink et al. | 252/3 |
| 4,159,081 | A | * | 6/1979 | Demler et al. | 239/323 |
| 4,567,948 | A | * | 2/1986 | Roznieck | 169/76 |
| 4,815,541 | A | * | 3/1989 | Arrington | 169/74 |
| 5,312,041 | A | * | 5/1994 | Williams et al. | 239/8 |
| 5,538,188 | A | * | 7/1996 | Simonette | 239/599 |
| 6,068,058 | A | * | 5/2000 | Ellis, Jr. et al. | 169/74 |
| 6,189,625 | B1 | * | 2/2001 | Hopkins | 169/88 |
| 6,231,778 | B1 | * | 5/2001 | Hansen | 252/3 |

FOREIGN PATENT DOCUMENTS

| | | | | | |
|---|---|---|---|---|---|
| DE | 2635531 | A | * | 2/1978 | A62C/31/02 |
| GB | 624803 | A | | 6/1949 | |
| GB | 2085567 | A | * | 4/1982 | F17C/7/00 |
| RU | 2083247 | C1 | | 7/1997 | |
| RU | 2111033 | C1 | * | 5/1998 | A62C/31/02 |
| SU | 1220703 | A | * | 3/1986 | B05B/1/14 |
| SU | 1296184 | A1 | | 3/1987 | |
| SU | 1657204 | A | * | 6/1991 | A62C/35/00 |
| WO | WO 9406517 | A1 | | 3/1994 | |

* cited by examiner

*Primary Examiner*—Patrick Brinson
(74) *Attorney, Agent, or Firm*—Rothwell, Figg, Ernst & Manbeck, PC

(57) ABSTRACT

The invention is aimed at generating a finely dispersed gas-and-drop flow with its cross-section in the shape of an ellipse and uniform intensity distribution. A fluid spray nozzle is built in the form of a body (1) with two coaxial channels (2) of the same cross-section designed for head liquid supply and a nozzle having a shape of a conical diffuser (3). The diffuser (3) is oriented transverse to the channels, the area of its inlet orifice not exceeding the total cross-section area of the channels. The fire extinguisher fitted with a fluid spray nozzle comprises a liquid vessel (4) for fire extinguishing, a liquid expulsion system, a pipeline (11), connecting a liquid cavity (5) of the vessel (4) to a spray nozzle and at least one valve or a regulator (8) to control the liquid supply to the spray nozzle.

15 Claims, 1 Drawing Sheet

FLUID SPRAY NOZZLE AND FIRE EXTINGUISHER

FIELD OF THE ART

The invention relates to fluid spraying techniques and can be used in fire extinguishing systems as a part of technological equipment, for burning fuel at heat power stations and the transport as well as for moistening the environments. The invention as a fire extinguisher can be employed as a member of stationary and mobile systems for fire fighting at different sites: in rooms of the hospitals, libraries, museums; on board a ship, an aircraft, etc.

PRIOR STATE OF THE ART

Known in the art are different types of fluid spray nozzles having an application, including that in fire fighting systems.

Thus, for instance, from a description to Author's Certificate SU 1220703 A (B05 B1/14, publ. 30.03.86) a fluid spray nozzle is known, the structure of which comprises spraying nozzles of head-striking action. The said nozzles are built in the form of through pairwise head-directed channels. These channels are inclined to the axis of symmetry of the spray nozzle body. The angle between the axes of symmetry of the channels is selected within 30° to 150° range. This structural spray embodiment allows to decrease energy supply for both fluid dispersion and spraying in the environment space.

The most close analogue of a fluid spray nozzle patented is a device described in Patent RU 2111033 C1 (A626 31/02, publ. 20.05.98). The known spray nozzle contains injectors placed in rows along the external surface of the body. Each injector is formed by two co-axial channels of the same cross-section provided for head liquid supply and a nozzle formed by a partial intersection of external conical passage and co-axial channel surface. The inlet orifice of the said nozzle is formed by intersection of internal surfaces of cylindrical channels and conical surfaces forming a nozzle. The spray nozzle of the said structure allows to create a uniform-in-volume flow of finely dispersed spray drops 30 to 150 $\mu$m in size. However, the said technical solution is aimed at generating a finely dispersed flow of drops in the environment volume but not a directed flow of drops of a preferred size with a particular cross-section, which is necessary, for instance, for effective fire extinguishing. The said requirement is of great importance while employing a fluid spray nozzle as a fire extinguisher structural member.

Besides, known are different types of fire extinguisher fitted with fluid spray nozzles. These fire extinguishers include, e.g., a device disclosed in the description to Author's Certificate SU 1657204 A1 (A62C 35/00, publ. 11.05.89). The said fire extinguisher comprises a fluid spray nozzle for fire fighting made in the shape of an exhaust branch pipe of a siphon pipe, a vessel with liquid, a liquid expulsion system and a pressurized gas bottle connected with a gas vessel cavity, and a siphon pipe, through which the liquid passes to the spray nozzle. The present technical solution is aimed at fire fighting efficiency increase on account of maintaining a desired pressure providing an ejection of the overall fire extinguishing substance mass. However, this device lacks any means of generating a directed finely dispersed gas-and-drop flow of a desired cross-section and means necessary to control the liquid supply for fire fighting.

The most closely analog device to the fire extinguisher patented is the one described in Application DE 2635531 A1

(A6 2C 31/02, publ. 09.02.78). The said fire extinguisher includes a fluid spray nozzle in the shape of a mouthpiece, a vessel with liquid for fire extinguishing, a liquid expulsion system and a pressurized gas bottle, pipes connecting a liquid vessel cavity and a spray nozzle, and regulators to control liquid supply to the spray nozzle. The above technical solution, though it is aimed at fire fighting efficiency increase (on account of simultaneous supply of foam-forming fluid and powder to the fire site), however it does not concern the improvement of the system spraying fluid into the environmental space.

SUMMARY OF THE INVENTION

The invention patented is aimed at developing a device enable to generate gas-and-drop flows of a preferred dimensional configuration that can be used for effective fire fighting with portable means of fire extinguishing—fire extinguishers applied. Achievement of the said technical result is connected with uniformity and, accordingly, intensity rate increase of fluid spraying over the total surface of a particular area.

A problem solved by the invention and aimed at obtaining a desired technical result consists in developing a finely dispersed gas-and-drop flow with a cross-section in the shape of an ellipse, with a special means applied. The above shape of a directed drop flow cross-section allows to effectively spray the fluid with certain intensity over large and small areas with a step-by-step spray nozzle displacement along the fire site surface.

Achievement of the said technical result is provided by the fact that in the fluid spray nozzle built in the shape of a body with two co-axial channels of the same cross-section designed for head liquid supply and a nozzle, the inlet orifice of which is formed by intersection of internal channel surfaces and the nozzle forming surface according to the present invention the nozzle is of a conical diffuser shape oriented transverse to the channels. The diffuser inlet orifice shall not exceeding the total area of channel cross-sections.

The said aggregate of essential features provides the ability to generate a finely dispersed gas-and-drop flow with an elliptical cross-section with the aid of spray nozzle.

In a preferred version of a spray nozzle structural design an angle between the axis of symmetry of the channels and axis of symmetry of a conical surface forming a diffuser is 89° to 91°. In this case a symmetrical finely-dispersed drop distribution of gas-and-drop flow over the area of its cross-section is achieved.

From a technological viewpoint it is preferred to build channels of a cylindrical shape.

The most uniform drop distribution in the flow generated is achieved in case of angle selection with a diffuser-forming cone vertex of 30° to 90°.

It is preferred to form a spray nozzle diffuser with a conical orifice made in the body. In this case a spray nozzle construction technology is simplified.

The above technical result is achieved with the aid of a fire extinguisher containing a fluid spray nozzle, a liquid vessel for fire extinguishing, a liquid expulsion system, a pipeline connecting a liquid vessel cavity and a spray nozzle and, at least, one valve or a regulator to control liquid supply to the spray nozzle, in which according to the present invention a fluid spray nozzle is built in the shape of a body with two co-axial channels of the same cross-section designed for liquid head supply. The spray nozzle must have a nozzle, the inlet orifice of which is formed by intersection of internal channel surfaces and nozzle-forming surface. The nozzle is of a conical diffuser shape and it is oriented transverse to the channels. The diffuser inlet orifice shall not exceeding a total cross-section area of the channels.

The said aggregate of essential features, which characterize a fire extinguisher structure, provide a finely dispersed gas-and-drop flow with an elliptical cross-section with the aid of a fire extinguisher.

In preferred embodiments of the said fire extinguisher an angle between the axis of symmetry of the spray nozzle and the axis of symmetry of a conical diffuser-forming surface can be 89° to 91°. The spray nozzle channels can be of a cylindrical shape. An angle at spray nozzle diffuser-forming cone vertex can be 30° to 90°. A spray nozzle diffuser can be formed by a conical orifice made in the body.

It is preferred for the fire extinguisher liquid expulsion siphon pipe to be placed in the vessel cavity to connect a liquid cavity with a fluid spray nozzle.

The most suitable liquid for fire extinguishing is water with a foam-forming agent. To increase effectiveness of liquid expulsion from a vessel some volatile liquids can be added to the water, preferably carbon dioxide—$CO_2$ and/or liquefied gas—$SF_6$.

A liquid expulsion system can be fitted with an elastic separation diaphragm separating a gas cavity of the vessel from its liquid cavity. This structure enables to exclude interaction of cavity pressurization gas and the liquid expelled.

BRIEF DESCRIPTION OF THE DRAWINGS

The invention patented is described with reference to a specific embodiment illustrated in the accompanying drawings, wherein.

PREFERRED EMBODIMENTS OF THE INVENTION

Figure 1:
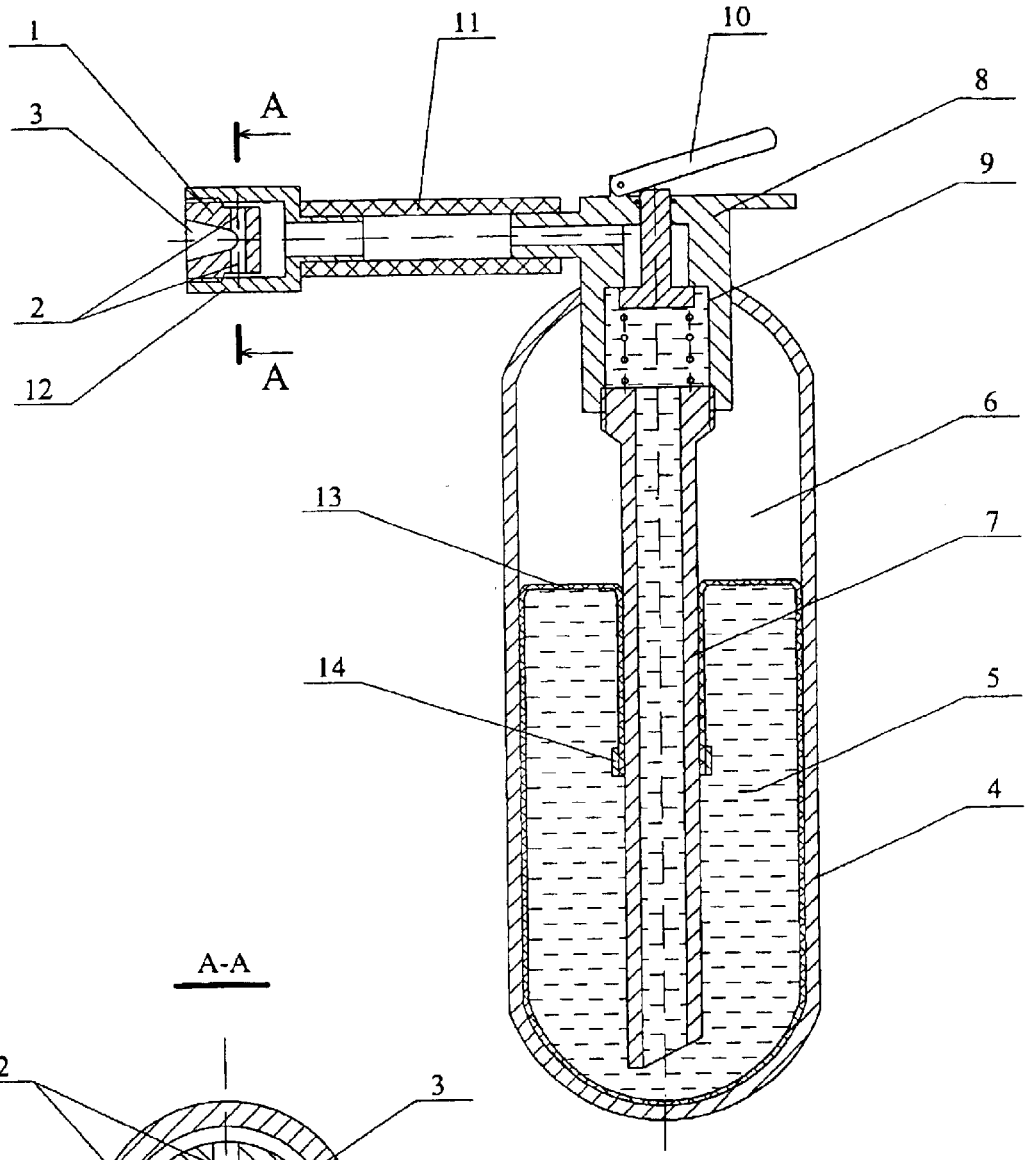
FIG. 1 is a schematic view of fire extinguisher and a spray nozzle connected to it.
Figure 2:
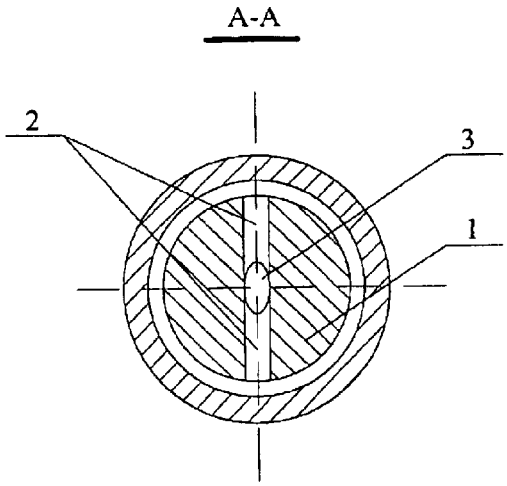
FIG. 2 is a transverse section of a spray nozzle in the inlet orifice of the diffuser scaled-up (two-fold scale-up).

A fluid spray nozzle illustrated in FIGS. 1 and 2 comprises the body 1, in which two co-axial cylindrical channels 2 are built designed for liquid head supply. A spray nozzle is built in the shape of the conical diffuser 3 formed by a conical orifice in the body 1 and oriented transverse to the channels 2. An angle between the axis of symmetry of co-axial cylindrical channels 2 and the axis of symmetry of a conical surface forming diffuser 3 is 90° (with account of technological error ±30'). An angle at cone vertex forming the diffuser 3 is 40°.

The inlet nozzle orifice (of the diffuser 3) is formed by intersection of internal channel surfaces and a conical surface forming a nozzle. The inlet orifice area of the diffuser 3 is 0.7 from a total cross-section area of the channels 2.

A fire extinguisher fitted with a spray nozzle of the said structure also includes the vessel 4 with fire extinguishing liquid, which can be preferably water and foam-forming agent. The vessel 4 consists of liquid 5 and gas 6 cavities. The liquid expulsion system contains the siphon pipe 7, which, via the control valve 8 comprising the spring-loaded closure 9 and the control lever 10, is connected with flexible pipeline 11. The body 1 of the spray nozzle is installed in the branch pipe 12, the cavity of which is connected with the liquid cavity 5 of the vessel 4 via the siphon pipe 7, the valve 8 and the flexible pipeline 1.

Liquid composition filling the vessel 4 can include a liquid volatile additive, for instance, liquefied carbon dioxide ($CO_2$) or ($SF_6$) gas to increase the liquid expulsion effectiveness from the vessel 4. To exclude pressurized gas of the vessel 4 and liquid interaction an elastic diaphragm 13 secured by a fastener 14 can be additionally installed.

The fluid spray nozzle and the fire extinguisher fitted with the said spray nozzle (see FIGS. 1 and 2) function in the following manner.

By the co-axial channels 2 the liquid is supplied under pressure of ~1 MPa (operating pressure range 0.3 to 3 MPa) in the form of the two head flows, which collide in the inlet orifice area of the diffuser 3. During interaction of head flows running out of a diffuser inlet orifice, the cross-section area of which is less than a total area of the feeding channels 2, a liquid flow cavitation takes place. In the course of fluid running out of the diffuser 3 a finely dispersed gas-and-drop flow with an elliptical cross-section is formed. As a result of experiments conducted it was determined that at the distance of 2 m from the spray nozzle exit section a gas-and-drop flow of an ellipse-shape cross-section with the greatest transverse dimension of 2.5 m and the least transverse dimension of 0.5 m is generated. Dispersivity of drops sprayed within the range of elliptical cross-section was 100 $\mu$m to 130 $\mu$m.

In the same manner the spray nozzle functions as a structural member of a fire extinguisher. A liquid vessel for fire extinguishing (with water) is filled preliminarily with gas up to a desired storage pressure (up to 3 MPa), the vessel may be filled with liquefied carbon dioxide or $SF_6$ gas as an additive.

The fire extinguisher functions in the following manner. In pressing the lever 10 the closure element 9 is released from the valve seat and the liquid under the excessive pressure developed by pressurized gas in the gas cavity 6 is expelled from the liquid cavity 5 of the vessel 4 through the siphon pipe 7 and the flexible pipeline 11. Then the liquid passes into the co-axial channels 2, in which head flows of the same rate are generated colliding in the area of the nozzle inlet orifice (of the diffuser 3). As a result of head liquid flow collision the atomizing of drops takes place at the orifice edges and a gas-and-drop flow with an elliptical form of its cross-section is generated. This shape of the flow elongated in its transverse cross-section allows to spray the fluid over rather a large fire site area with a step-by-step spray nozzle displacement along the surface of the fire site. The fluid spray nozzle displacement possibility along the fire site surface of a large area is determined by a length of the flexible pipeline 11 and the total fire extinguisher mass.

A preferred duration and intensity of gas-and-drop flow supply is controlled by the lever 10 of the valve 8 built in the vessel 4. To increase liquid expulsion effectiveness the volatile liquids can be utilized, preferably liquefied carbon dioxide ($CO_2$) and gas ($SF_6$). These substances are added to the liquid (water) for fire extinguishing. At pressure decrease less than the saturated vapor pressure of volatile additives in the vessel 4 during a process of liquid expulsion their vaporization takes place resulting in automatic pressure maintenance at the level preferred in the gas cavity 6 and liquid ejection via the spray nozzle does not become lower than the acceptable level.

To exclude pressurization gas and expulsion liquid interaction, including chemical interaction and liquid satu ration with gas, the liquid cavity 5 is separated from the gas cavity 6 by a hermetic separation diaphragm made of an elastic material (not shown in the drawing). Though this embodiment of liquid expulsion system makes the fire extinguisher structure more complex, however, in this case its operation reliability increases. In the simplest version of embodiment, when water is used as liquid for fire extinguishing with inert gas utilized as pressurization gas, there is no necessity to use a separation diaphragm.

To stop a fire extinguisher operation one must release the lever 10 of the valve 8. The closure component 9 under the force of a compressed spring is displaced to a valve seat and shuts its passage cross-section, thus cutting off the fluid supply via the spray nozzle.

Fire fighting efficiency with the help of a fire extinguisher built according to the present invention is ensured on account of ability to generate a gas-and-drop flow with its elliptical cross-section and uniform intensity and dispersity of drops along the flow cross-section. This elongated (approaching rectangular) shape of the flow cross-section allows to more effectively, in comparison with a round shape of the flow cross-section commonly applied, distribute the dispersed fluid over the fire site, the area of which considerably exceeds the gas-and-drop flow cross-section area. The solution of the problem enables to lower the liquid consumption, the capacity of which is determined by the vessel 4 volume, for fire site extinguishing.

As a result of experiments conducted it was established that generation of gas-and-drop flow with an elliptical cross-section and uniform intensity and dispersity is ensured on account of employing a spray nozzle in the form of a conical diffuser oriented transverse to feeding co-axial channels. The area of the diffuser inlet orifice formed by intersection of internal channel surfaces and diffuser-forming surface should not exceed a total cross-section area of the channels. These conditions determine the ability of achieving a desired technical result.

Industrial Application

The invention may be used in different fields of engineering where it is required to generate spraying fluid flows both in closed and open space. A spray nozzle may be used in fire extinguishing systems, as a part of technological equipment, for burning fuel at heat power stations and the transport, moistening the environment as well as spraying different chemicals over agricultural lands and in industrial premises. The fire extinguisher fitted with a fluid spray nozzle according to the invention may find its application as a standard equipment for fire extinguishing at different objects: in the rooms of hospitals, libraries, museums, on board a ship, an aircraft and other sites of importance.

Through a group of inventions patented is described at the example of a preferred embodiment, a specialist in this field of engineering acknowledges that structural improvements and other embodiments can take place without deviation from the invention subject characterized by the claims defining the invention.

What is claimed is:

1. A fluid spray nozzle made in the form of a body (1) with two co-axial channels (2) of the same cross-section designed for head liquid supply and a nozzle, an inlet orifice of which is formed by intersection of internal channel surfaces and a nozzle-forming surface, wherein the nozzle is formed as a conical diffuser (3) with an angle at the diffuser-forming cone vertex oriented transverse to the channels (2), the diffuser (3) inlet orifice area not exceeding a total cross-section area of the channels (2).

2. The spray nozzle of claim 1, wherein an angle between an axis of symmetry of the channels (2) and an axis of symmetry of a conical surface forming the nozzle (3) is 89° to 91°.

3. The spray nozzle of claim 1, wherein the channels (2) are of a cylindrical shape.

4. The spray nozzle of claim 1, wherein an angle at the nozzle (3)—forming cone vertex is 30° to 90°.

5. The spray nozzle of claim 1, wherein the nozzle (3) is formed by a conical orifice made in the body (1).

6. The fire extinguisher comprising a fluid spray nozzle, a vessel (4) containing liquid for fire extinguishing, a liquid expulsion system, a pipeline (11) connecting a liquid vessel cavity (5) with the fluid spray nozzle and at least one valve or a regulator (8) to control the liquid supply to the fluid spray nozzle, wherein the fluid spray nozzle is made in the form of a body (1) with two co-axial channels (2) of the same cross-section designed for head liquid supply and a nozzle, an inlet orifice of which is formed by intersection of internal surfaces of the channels and a nozzle-forming surface, wherein the nozzle is formed as a conical diffuser (3) with an angle at the diffuser-forming cone vertex and oriented transverse to the channels (2) with an inlet orifice area of the diffuser (3) not exceeding a total cross-section area of the channels (2).

7. The fire extinguisher of claim 6, wherein an angle between an axis of symmetry of the channels (2) and an axis of symmetry of a conical surface forming the nozzle (3) is 89° to 91°.

8. The fire extinguisher of claim 6, wherein the spray nozzle channels (2) have a cylindrical shape.

9. The fire extinguisher of claim 6, wherein an angle at a vertex of a cone forming nozzle (3) is 30° to 90°.

10. The fire extinguisher of claim 6, wherein the nozzle (3) is formed by a conical orifice made in the body.

11. The fire extinguisher of claim 6, wherein the liquid expulsion system has a siphon pipe (7) installed in the vessel cavity.

12. The fire extinguisher of claim 6, wherein the liquid for fire extinguishing is water with a foam-forming agent.

13. The fire extinguisher of claim 6, wherein the liquid for fire extinguishing includes a volatile fluid.

14. The fire extinguisher of claim 6, wherein the liquid for fire extinguishing includes a volatile fluid, liquefied carbon dioxide $CO_2$ and/or liquefied $SF_6$ gas.

15. The fire extinguisher of claim 6, wherein the liquid expulsion system is fitted with an elastic separation diaphragm separating a gas cavity from the liquid cavity.

* * * * *